United States Patent [19]

Zieg

[11] Patent Number: 4,723,388

[45] Date of Patent: Feb. 9, 1988

[54] EASILY FORMABLE GRID FOR WINDOWS AND THE LIKE

[75] Inventor: Steven A. Zieg, Anaheim Hills, Calif.

[73] Assignee: Mansion Industries, Inc., City of Industry, Calif.

[21] Appl. No.: 938,730

[22] Filed: Nov. 3, 1986

Related U.S. Application Data

[63] Continuation of Ser. No. 727,856, Apr. 26, 1985, abandoned.

[51] Int. Cl.[4] ..... E04C 2/38; E04C 2/42

[52] U.S. Cl. ..... 52/665; 52/456; 52/656; 52/664; 403/174

[58] Field of Search ..... 52/456, 665, 664, 660, 52/656; 403/174

[56] References Cited

U.S. PATENT DOCUMENTS

| | | | |
|---|---|---|---|
| 560,937 | 5/1896 | Ryan . | |
| 1,814,317 | 7/1931 | Lebherz . | |
| 1,910,160 | 5/1933 | Gorman | 52/665 |
| 3,058,517 | 10/1962 | Jacobs et al. . | |
| 3,224,048 | 12/1965 | Sullivan . | |
| 3,307,316 | 3/1967 | Gray . | |
| 3,340,661 | 9/1967 | Krieger . | |
| 3,358,412 | 12/1967 | Martin . | |
| 3,372,522 | 3/1968 | Engstrom . | |
| 3,411,258 | 11/1968 | Kessler . | |
| 3,474,587 | 10/1969 | Martin . | |
| 3,628,299 | 12/1971 | Nakazawa | 52/665 |
| 3,785,110 | 1/1974 | Galloway et al. | 52/665 |
| 3,787,130 | 1/1974 | Hemmings et al. | 52/665 |
| 3,942,576 | 3/1976 | Rickard . | |
| 3,958,889 | 5/1976 | Berkowitz | 52/665 |
| 4,060,950 | 12/1977 | Rackard et al. | 52/665 |
| 4,353,661 | 10/1982 | Ruther | 403/174 |

FOREIGN PATENT DOCUMENTS

| | | | |
|---|---|---|---|
| 2143160 | 3/1973 | Fed. Rep. of Germany | 52/665 |
| 2248243 | 4/1974 | Fed. Rep. of Germany | 52/665 |
| 2527704 | 12/1976 | Fed. Rep. of Germany | 52/665 |
| 1400599 | 4/1965 | France | 403/174 |
| 426176 | 6/1967 | Switzerland | 52/665 |
| 2054716 | 2/1981 | United Kingdom | 52/456 |

*Primary Examiner*—William F. Pate, III
*Assistant Examiner*—Michael Safavi
*Attorney, Agent, or Firm*—William W. Haefliger

[57] ABSTRACT

A grid, the size of which is selectable to conform to a window opening, or the like, comprising (a) multiple couplings, and (b) elongated grid members having slidable telescopic interfit with said couplings to define (i) peripheral frame members, and (ii) other members which extend between the frame members.

9 Claims, 21 Drawing Figures

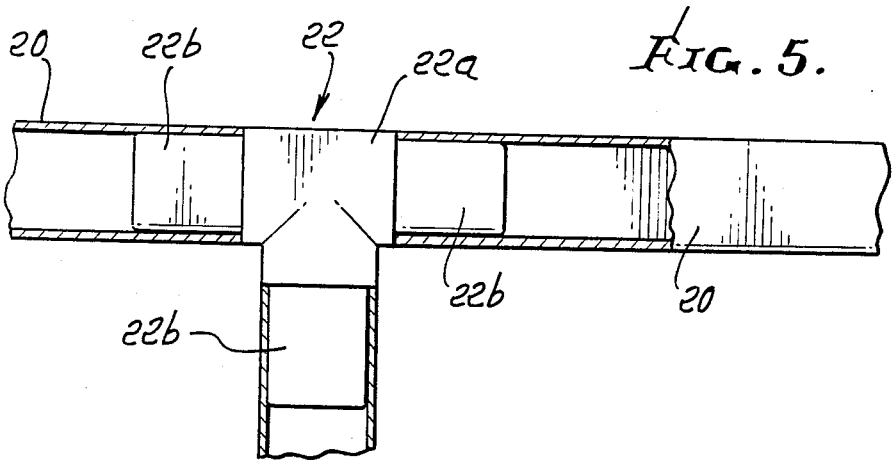
FIG. 5.
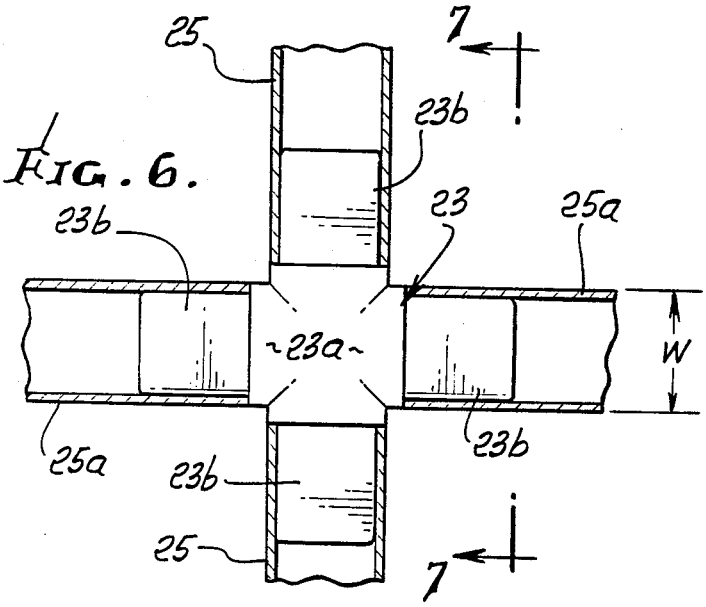
FIG. 6.
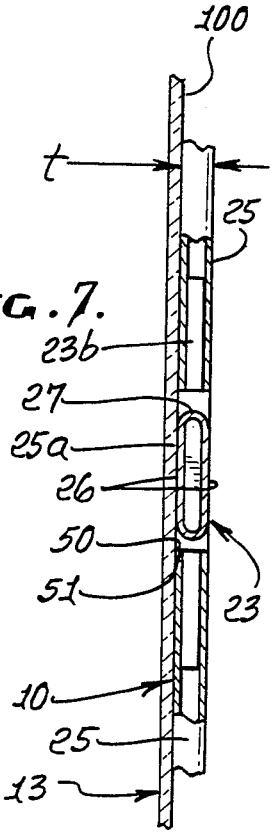
FIG. 7.
FIG. 9.
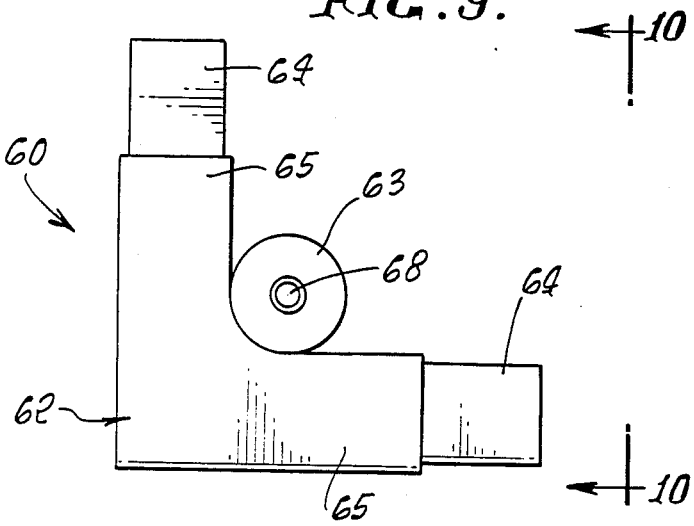
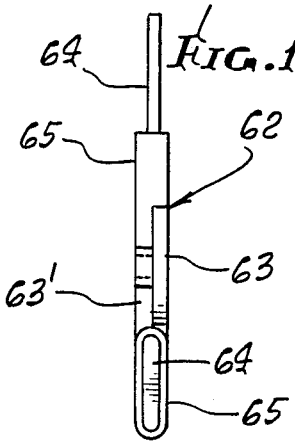
FIG. 10.

EASILY FORMABLE GRID FOR WINDOWS AND THE LIKE

This is a continuation, of application Ser. No. 727,856, filed Apr. 26, 1985 now abandoned.

BACKGROUND OF THE INVENTION

This invention relates generally to window framing, and more particularly to grids or grilles that are easily installed onto existing window glass to impart a Colonial apppearance to such windows, at low cost.

There is a need for grids or grilles of the above type; however, problems exist in that window openings are of many different sizes, and premanufactured grilles cannot easily be enlarged or reduced in size to fit many different window or pane sizes. Thus, premanufactured grilles are typically of one size only, so that they do not accurately fit many windows of odd size, even though such grilles themselves may be made in different standard sizes. Also, disassembly and re-assembly of such grilles is extremely difficult.

SUMMARY OF THE INVENTION

It is a major object of the invention to provide solutions to the above problems, through a novel grid, and parts of same, which enable easy grid assembly from a kit; easy forming of the grid parts to size as dictated by particular windows; and low-cost construction of the components.

Basically, the grid or grille comprises:

(a) multiple elongated members extending in X or Y directions which have intersections, (b) means interconnecting said members at said intersections, (c) said members having slat-like cross sections in planes normal to the lengths of said members, the members each having parallel opposite walls, (d) said members consisting of synthetic resin.

As will appear, the members may advantageously be hollow and consist of extruded synthetic resin, facilitating light weight construction and enabling ready cutting to length; the means interconnecting the members may comprise couplings that may have flat, parallel opposite side walls, the corresponding side walls of the couplings and members being in substantially the same planes; or such interconnections may comprise pivots allowing the members to pivot to change the angles between said X and Y directions. The grid may be assembled, sized, and installed adjacent a window pane to create a "Colonial" appearance.

In that form of the invention employing fixed couplings the latter typically have telescopic interfit with frame members and other members, which may be cut to length to create the accurately sized grid. Such members may have slat-like cross sections in planes normal to the lengths of said members, and may be hollow as described. The couplings may also consist of synthetic resin and be provided with slat-like tongues to slidably and frictionally interfit the cut-to-length frame and other elongated members; and the couplings may have flat elbow, tee and cross shape, as will appear.

It is a further object of the invention to provide couplings having intermediate portions and first tongues projecting therefrom and integral therewith, and second tongues having associated bases pivotally connected to said intermediate portions; two of the second tongues and associated bases may be pivotally connected to a single intermediate portion, so that said two tongues may be pivoted into alignment with other members extending in different directions. Accordingly the X and Y directions may be established with desired angularity therebetween.

These and other objects and advantages of the invention, as well as the details of an illustrative embodiment, will be more fully understood from the following specification and drawings, in which:

DRAWING DESCRIPTION

FIGS. 4–6 are enlarged fragmentary views taken on lines 4—4, 5—5 and 6—6 of FIG. 1;

FIG. 7 is a section on lines 7—7 of FIG. 6;

Figure 8:
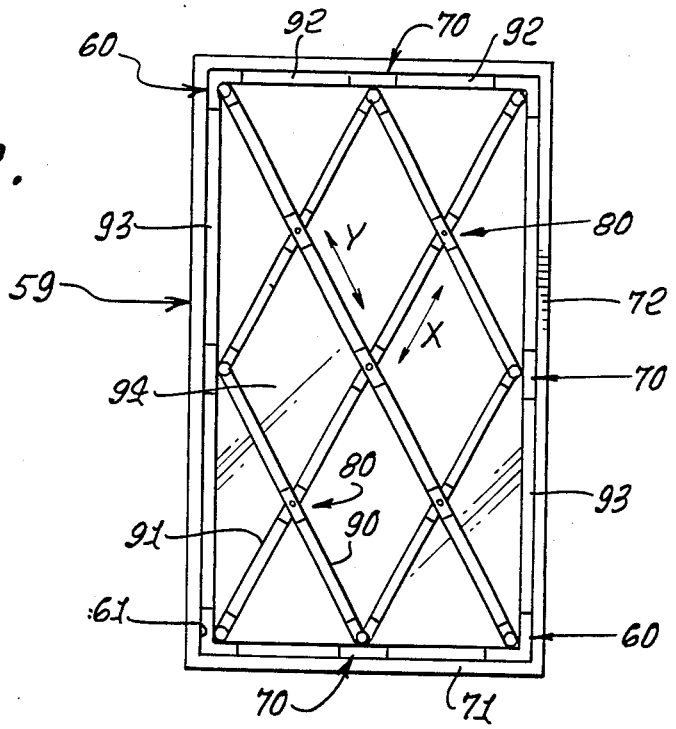
FIG. 8 is an elevation showing a modified grid.
Figure 11:
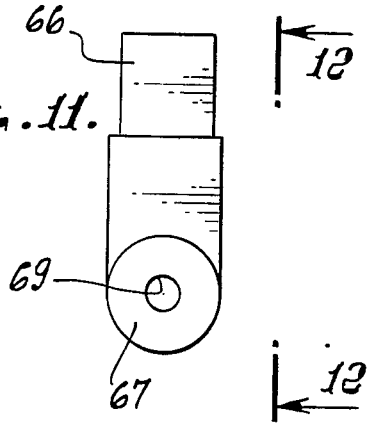
Figure 12:
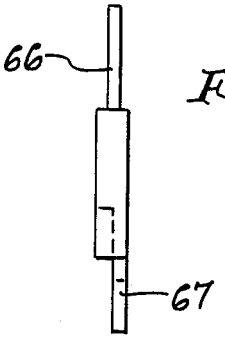
Figure 13:
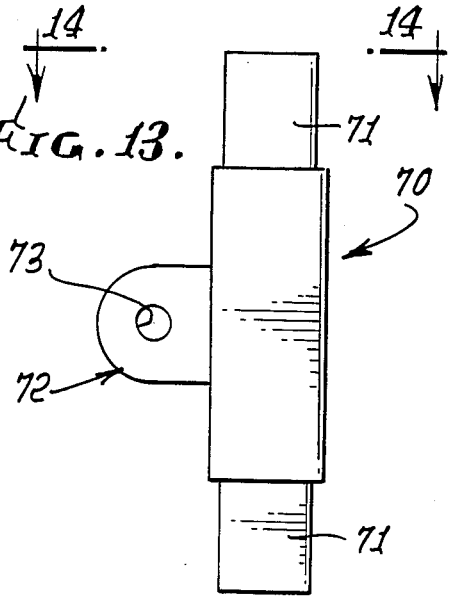
Figure 14:
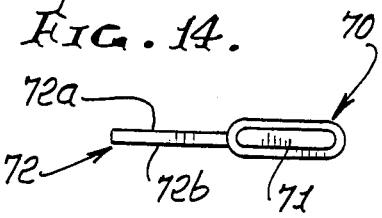
Figure 15:
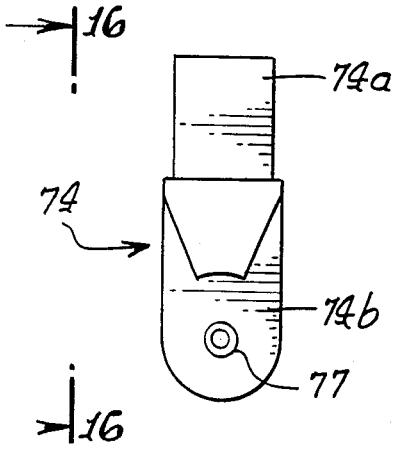
Figure 16:
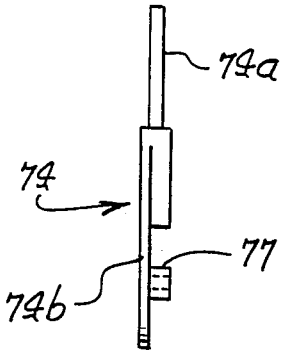
Figure 17:
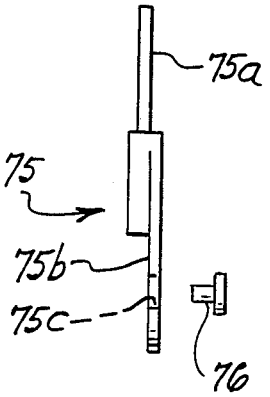
Figure 18:
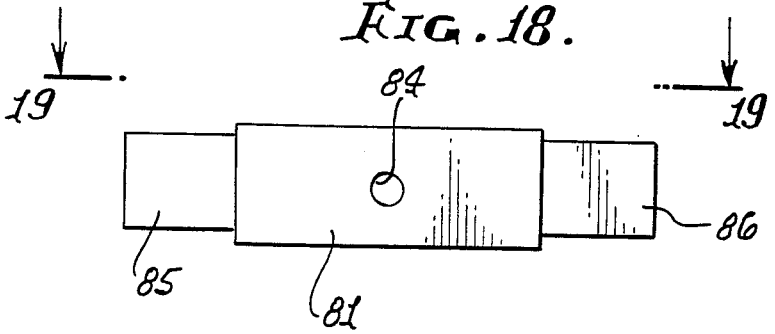
Figure 19:
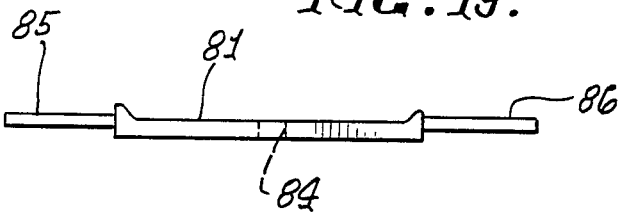

FIG. 9 a side elevation showing an elbow shaped coupling usable in the FIG. 8 grid;

FIG. 10 an end elevation on lines 10—10 of FIG. 9;

FIG. 11 is a side elevation showing a bore and tongue pivotally connectible to the FIG. 9 coupling;

FIG. 12 is an edge elevation taken on lines 12—12 of FIG. 11;

FIG. 13 is a side elevation showing a T-shaped coupling usable in the FIG. 8 grid;

FIG. 14 is an end view taken on lines 14—14 of FIG. 13;

FIG. 15 is a side elevation showing a bore and tongue pivotally connectible to the FIG. 13 coupling;

FIG. 16 is an edge elevation taken on lines 16—16 of FIG. 15;

FIG. 17 is a view like FIG. 16, showing a modified bore and tongue;

FIG. 18 is a side elevation showing a coupling member usable in a cross connection shown in FIG. 8;

FIG. 19 is an edge view of the FIG. 18 coupling members; and

Figure 20:
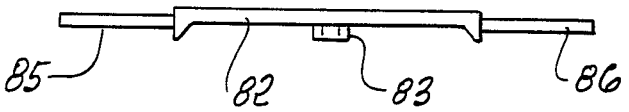

FIG. 20 is a view like FIG. 19, showing a complementary coupling member.

DETAILED DESCRIPTION

Figure 1:
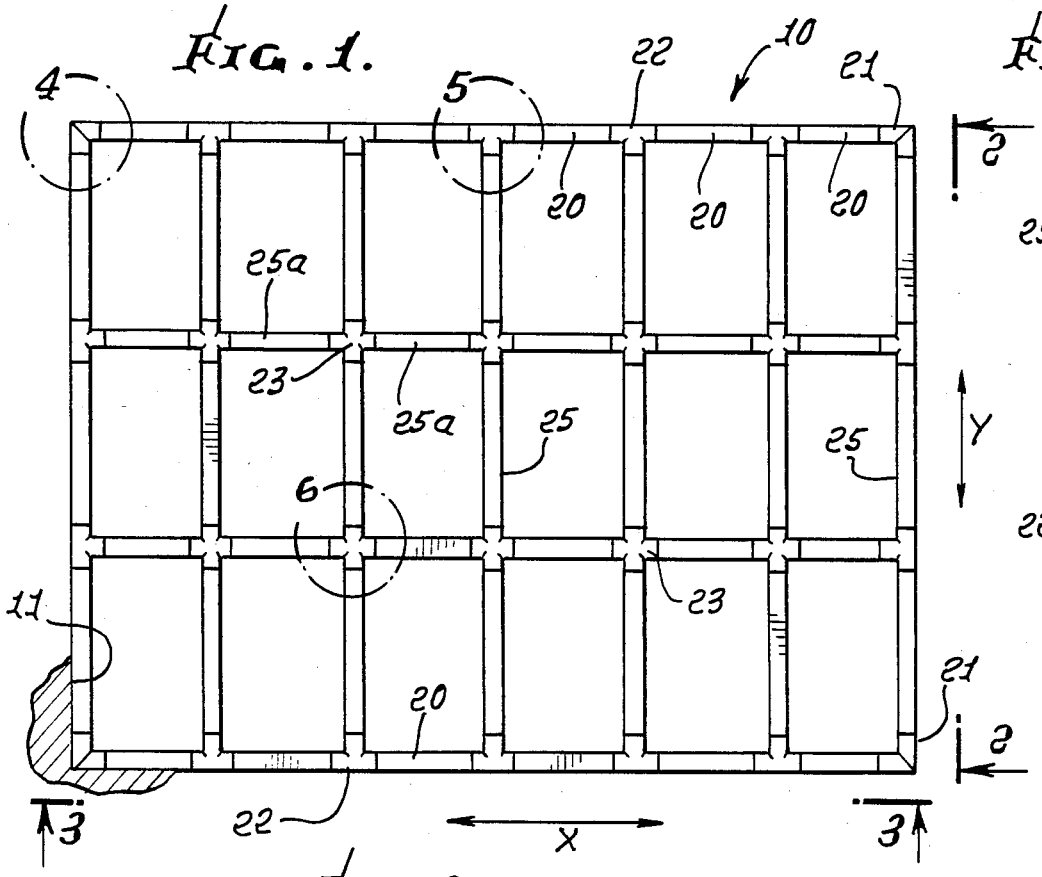
FIG. 1 is a side elevation showing a gridwork incorporating the invention, installed in a window opening.
Figure 2:
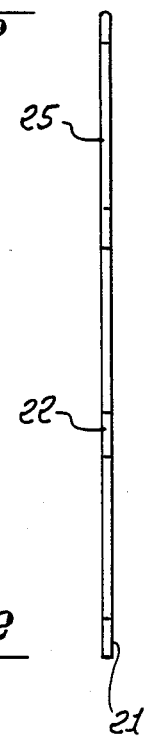
FIG. 2 is an end elevation taken on lines 2—2 of FIG. 1.
Figure 3:
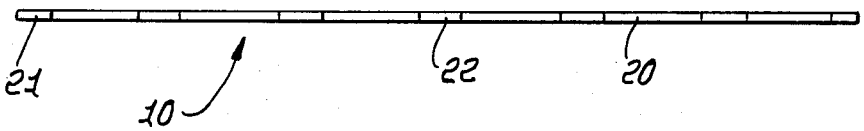
FIG. 3 is a bottom plan view taken on lines 3—3 of FIG. 1.
Figure 1A:
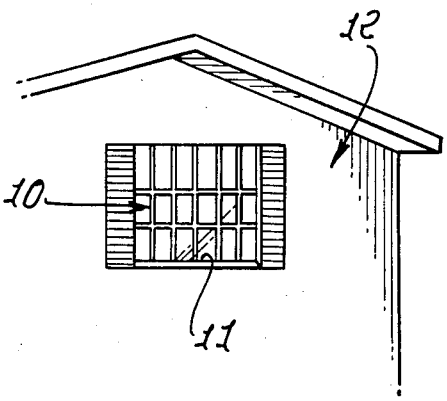
FIG. 1*a* shows a dwelling with a window having an installed Colonial grid.

The basic grid 10, or gridwork, in FIG. 1 is adapted to be easily formable or size controllable, to conform to a predetermined window size opening 11, as for example is associated with a dwelling 12, seen in FIG. 1*a*. The intention is that the amateur installer can work from a kit of frame and other elongated members, and couplings, to easily install a "Colonial", or other grid-like window pattern adjacent a large, "gridless" glass window pane, to create the desired Colonial window appearance. Such a grid 10, installed next to a glass pane 13, is seen in FIG. 7. Adhesive may be used to bond the grid to the pane at 100, if desired.

Figure 4:
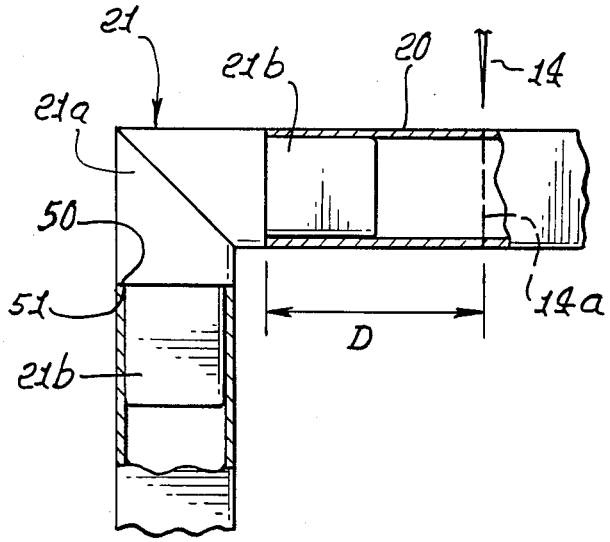

The grid 10 basically comprises multiple elongated members extending in X and Y directions which have intersections; means interconnecting the members at the intersections; the members consisting of synthetic resin (such as extruded polyvinyl chloride); the construction being such as to readily adapt to layering adjacent a glass window pane, as referred to; and the members being easily formable to different size window openings (for example, the elongated plastic can be cut at any location to reduce their lengths, i.e., reduce the grid size in either or both of the X and Y directions. Typically, the X and Y directions may be horizontal and vertical as shown by arrows in FIG. 1, with 90° angularity, therebetween. See in this regard, a scissors or knife 14 in FIG. 4, readied to cut frame member 20 at location 14*a*, to reduce the length of that member by the amount D, or other amount, as desired.

More specifically, and referring to FIGS. 2–7, the grid 10 is made up of multiple couplings, as indicated by for example by L-shaped corner couplings 21, T-shaped intermediate couplings 22, cross-shaped intermediate couplings 23; and elongated grid, members having slidable telescopic interfit with the couplings. The grid members may be considered to include:

(i) peripheral frame members, as at 20, and (ii) other members, as at 25 and 25*a* which extend between the frame members 20.

The frame members 20 and other members 25 and 25*a* all have slat-like cross sections in planes normal to their lengths, as for example is seen in FIG. 7. These slat-like cross sections are hollow along the lengths of the members, so as to make it easy to cut them to length, as by a scissors or knife, as referred to. They consist of synthetic resin, such as extruded polyvinyl chloride; they have opposite side walls 26, and curved or outwardly convex endwalls 27, and their widths are substantially greater than (at least about three times greater than) their thickness; for example, the width "W" is typically between ½ and 1 inch; and section thickness "T" is between ⅛ and ¼ inch.

The couplings 21, 22 and 23 have corresponding main body portions 12*a*, 22*a* and 23*a* and tongues protruding from the latter to slidably and closely fit, telescopically, the ends of members 20, 25 and 25*a*. Such tongues 21*b*, 22*b*, and 23*b* may have oval or slat-like cross sections with matching interfit to the openings defined by the ends of the members 20, 25 and 25*a*. That interfit is characterized as frictional and slidable, for ease of assembly, and retention of the grid elements in assembled relation. The couplings may consist of molded synthetic resin such as PVC. Stop shoulders 50 and 51 engage, as shown.

Accordingly, the grid is easily packaged and shipped in dis-assembled state, and readily assembled by the amateur builder or carpenter, to result in an appealing, low-cost, "Colonial look" window.

FIG. 8 shows a modified grid having multiple couplings indicated by corner couplings 60, side (T-shaped) couplings 70, and intermediate (cross-shaped) couplings 80. Couplings 60 fit adjacent the corner 61 of window frame 59); couplings 70 fit adjacent the frame members 71 and 72, as shown; and couplings 80 are located in the window opening space to interfit diagonally extending grid members 90 and 91. Peripherally extending frame members 92 and 93 extend between couplings 60 and 70. All of these members are located adjacent a glass pane 94 carried as by frame 59.

Referring to FIGS. 9–12, corner coupling 60 has been elbow shaped intermediate portion 62, and a circular tab 63 at the elbow inside corner to define a pivotal connections. Tongues 64 project from elbow arms 65, and correspond to tongues 21*b*. A second tongue 66 has an intergral base 67 that fits sidewardly against tab 63 (in space 67' in FIG. 10), and a central pivot 68 on tab 63 is received in bore 69 in base 67. Therefore, tongue 66 can pivot to locate member 91 at a desired adjusted angle, in FIG. 8, to fit frame 59.

Referring to FIGS. 13–17, side coupling 70 has endwise projecting tongues 71 to interfit side frame mebers 92, or 93. A side tab 72 defining a pivot opening 73. Members 74 and 75 define tongues 74*a* and 75*a* that interfit elongated members 90 and 91. Bases 74*b* and 75*b* are shaped to fit flatly against opposite sides 72*a* and 72*b* of tab 72, and a pivot pin 76 passes through opening 75*c* in base 75*b*, through hole 73, and into a sleeve 77 on base 74*b*, to establish the connection. X and Y directions may be non-perpendicular as shown, or perpendicular; but the grid members 90 and 91 run diagonally.

Referring to FIGS. 18–20, cross piece coupling 80 includes elongated base members 81 and 82 that interfit and have pivoted connection as via a pin 83 on member 82 interfitting a hole 84 in member 81. Tongues 85 and 86 on the members extend endwise oppositely to interfit grid members 90 and 91. Pivotability of members 81 and 82 permits selected adjustment of the diagonal angularity of grid members 90 and 91, in directions X and Y.

The components of a window grid kit typically contain enough connectors and extruded strip material to achieve a wide variety of grid patterns and window shapes and size. The easily assembled grid is light in weight and can be affixed to the window glass with Velcro strips or simple clip retainers, which would penetrate the wood or slide under rubber window seal. The assembly can be easily removed for cleaning the glass or repainting the window and grids. Assembly is made easy since each connector has a fixed length, so that a simple subtraction from window dimensions can determine length of material needed between connectors. A press fit design eleminates need for gluing or screw attachment. Additionally the assembly can be produced to a thickness of less than ¼ inch, to eliminate interference in most sliding window configurations.

Since the product fits any size window it allows retailer to stock grids rather than special order, and permits the homeowner to purchase without the need to obtain precise window measurements.

I claim:

1. A grid, having a size which is selectable to conform to a window opening, or the like, comprising:

(a) multiple couplings having flat, parallel opposite side walls, and (b) elongated grid members having a slidable telescopic interfit with said couplings to define (i) peripheral frame members, and (ii) other members which extend between the frame members, (c) the grid members being hollow along their lengths, and having flat parallel opposite side walls, the widths of each of said grid members in directions parallel to said side walls being everywhere at least about three times the thickness of each of said grid members in directions normal to and between said flat side walls, said widths being between ½ and 1 inch, and said thicknesses being between ⅛ and ¼ inch, (d) the couplings defining tongues telescopically closely slidably endwise interfitting the ends of said hollow grid members as the tongue slide endwise into the grid members, corresponding entire outer side walls of the couplings and members being co-planar, (e) the couplings and grid members consisting of polyvinylchloride material, the grid members being cuttable to desired lengths, (f) and including interengaged stop shoulders on said couplings and members limiting tongue reception into said members, each of said tongues extending from a plane of said coupling shoulder and defining a root end where said tongue meets said plane of said shoulder the said shoulders extending about the tongues at the root ends thereof, the couplings and members having exterior flush surfaces, (g) the tongues and grid members having interengaged flat slide surfaces at opposed sides thereof and interengaged curved slide surfaces along edges thereof, (h) and including a glass window pane at one side of which the grid is located to extend parallel to the pane, thereby to create a Colonial window appearance, certain tongues adjusted in said members so that the grid fits the elongated window pane, the grid members being attached to the pane.

2. The grid of claim 1 wherein said frame members have slat-like cross sections in planes normal to the lengths of said members.

3. The grid of claim 2 wherein said other members have slat-like cross sections in planes normal to the lengths of said members.

4. The grid of one of claims 2 or 3 wherein said slat-like cross sections are hollow along lengths of said members.

5. The grid of claim 1 wherein said tongues are slat-like in shape, and in cross section, and are elongated.

6. The grid of claim 5 wherein said couplings have a T-shape, L-shape and cross shape.

7. The grid of claim 1 wherein said couplings are of one-piece construction.

8. The grid of claim 5 wherein there are four tongues carried by each coupling.

9. The grid of claim 8 wherein a first pair of tongues extend endwise oppositely in an X direction, and a second pair of tongues extend endwise oppositely in a Y direction.

* * * * *